US006085669A

United States Patent [19]

Marchand et al.

[11] Patent Number: 6,085,669

[45] Date of Patent: Jul. 11, 2000

[54] MULTIPURPOSE TABLE

[75] Inventors: Christophe Marchand; Alfredo W. Häberli, both of Zürich, Switzerland

[73] Assignee: Gebruder Thonet GmbH, Frankenberg, Germany

[21] Appl. No.: 09/284,373

[22] PCT Filed: Oct. 10, 1997

[86] PCT No.: PCT/EP97/05601

§ 371 Date: Jul. 30, 1999

§ 102(e) Date: Jul. 30, 1999

[87] PCT Pub. No.: WO98/16133

PCT Pub. Date: Apr. 23, 1998

[30] Foreign Application Priority Data

Oct. 14, 1996 [DE] Germany ..... 196 42 391

[51] Int. Cl.[7] ..... A47B 7/00

[52] U.S. Cl. ..... 108/91; 108/119

[58] Field of Search ..... 108/91, 97, 93, 108/115, 119

[56] References Cited

U.S. PATENT DOCUMENTS

| | | | |
|---|---|---|---|
| 2,762,669 | 9/1956 | Watson | 108/91 |
| 2,851,166 | 9/1958 | Block | 108/91 X |
| 2,871,073 | 1/1959 | Swanson . | |
| 3,429,449 | 2/1969 | Hamilton et al. | 108/91 X |
| 3,556,076 | 1/1971 | Stewart | 108/119 X |
| 4,067,606 | 1/1978 | Desmoulins nee Fouchereau et al. . | |
| 5,086,711 | 2/1992 | Matthews | 108/119 |
| 5,509,360 | 4/1996 | Chiu | 108/119 |
| 5,542,359 | 8/1996 | Polries | 108/119 X |
| 5,613,448 | 3/1997 | Petty | 108/91 |
| 5,848,822 | 12/1998 | Wu | 108/119 X |

FOREIGN PATENT DOCUMENTS 1167806 10/1969 United Kingdom .

*Primary Examiner*—José V. Chen

*Attorney, Agent, or Firm*—John W. Cornell; D'Ancona & Pflaum LLC

[57] ABSTRACT

A new and improved multi-purpose table includes a tabletop which may be rotated between a lowered, horizontal position for use and a raised vertical position for storage. A plurality of the multi-purpose tables in their raised storage position may be stacked together in a high density nested and stacked array. The table includes a load bearing structure including a vertical frame member having an underside portion and an opposed upside portion and a divergent V-shaped frame member having a pair of divergent angled leg portions. The vertical height of the V-shaped frame is less than the height of the vertical frame member to permit nested stacking. The tabletop is hingedly pivotally mounted to the upside of the vertical frame member. In a preferred embodiment, rollers are rotatably mounted to the underside portion of the vertical frame member.

16 Claims, 6 Drawing Sheets

FIG. 2 A
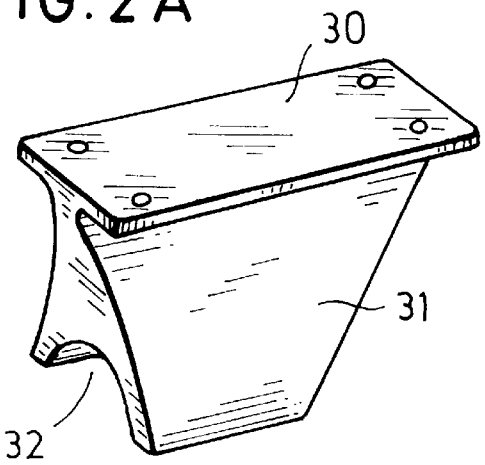
FIG. 2 C
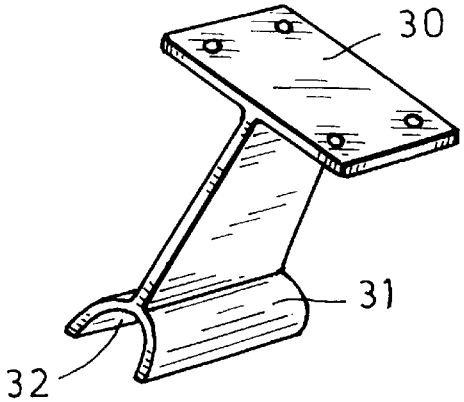
FIG. 2 B
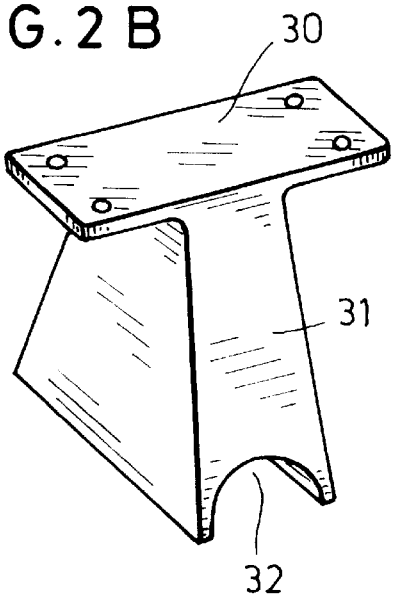
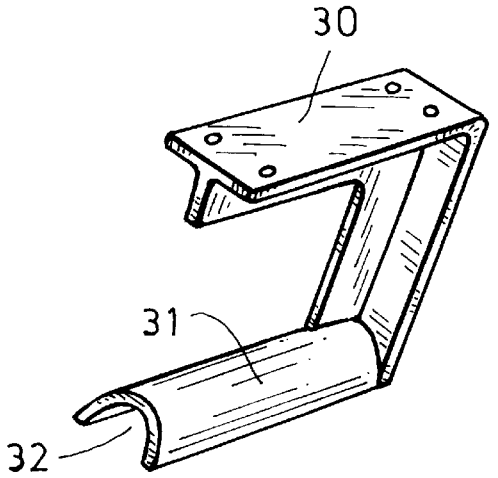
FIG. 2 D

MULTIPURPOSE TABLE

BACKGROUND OF THE INVENTION

The invention is directed to a table with a tabletop and a load-bearing structure with wheels for the tabletop.

Since they can be rolled, such tables are suited for use at various locations or, respectively, for constructing a table arrangement with an enlarged table surface, for example for conference purposes. In order to fix the table position, the rollers of the table can be fashioned as, for example, stop casters and/or only two of, for example, four table legs can be provided with rollers, whereas the other two table legs fix the position of the table, which can be easily displaced and maneuvered by lifting at that end at which the table legs free of rollers are provided.

What is disadvantageous about such rollable tables, as well as, moreover, given non-rollable tables, however, is an at most limited stackability. Given tables of the same size, these can be arranged in stacks of two with their tabletops lying on top of one another. Given preferably identical tables of different sizes and different heights, these can also be stacked in greater numbers limited, however, by their utilization. A stacking or, respectively, stowing of a greater plurality of tables of the same size, however, has not been hitherto possible, for which reason—precisely in conjunction with conference rooms—the tables must, when not being used, be either placed against the walls or stored in a separate room.

SUMMARY OF THE INVENTION

An object of the present invention is comprised in improving the initially cited table such that it can be stacked in large unit numbers in space-saving fashion.

This object is achieved by a table having the features of claim 1. Advantageous developments of the invention are recited in the subclaims.

In accord therewith, a horizontal stacking of a plurality of tables with high stacking density can be achieved on the basis of the inventive table in that, first, the tabletop can be folded up at one table end, preferably at the table end that is provided with rollers, whereas, on the other hand, the table frame that is thereby freed projects to such an extent from the folded-up tabletop, exhibits a general V-shape and lies lower than at least the lower edge of the folded-up tabletop so that a plurality of tables given folded-up tabletop can be horizontally stacked with tabletops adjacent to one another and frames nested inside one another. As soon as the tables stacked in this way are separated and the tabletop is folded down into a horizontal use position in which it rests on the frame, the table can be used in the traditional way or individually or placed against one another.

In detail, the tabletop load-bearing structure is inventively composed of a vertically proceeding frame to whose upper side the tabletop is pivotably articulated and of a support for this vertical frame that, proceeding from the frame, comprises legs that diverge essentially V-shaped and stand on the substrate distanced from the frame and onto which the table top can be folded down into a horizontal use position.

Advantageously, the V-shaped support proceeds at least essentially horizontally under the folded-down tabletop and then merges into vertically downwardly proceeding table legs. What is thereby achieved is that this table, which can be horizontally stacked in great numbers, assures the same led freedom as a traditional table of the species under discussion.

In order to lend the inventively stackable table the necessary stability in the area of the vertically proceeding frame as well and to also assure an appealing appearance of the overall tabletop load-bearing structure, the vertically proceeding frame of the structure is fashioned as a U-shaped frame standing on its head whose lateral legs form table legs and to whose upwardly disposed, horizontal base the tabletop is pivotably hinged.

The drag bearings for the tabletop can be formed in a traditional way. However, plastic formed parts with aligning bores for the passage of the horizontal base of the U-shaped vertical frame that are secured to the underside of the tabletop are preferred.

Since, for the horizontal stackability of the table, the generally V-shaped support of the tabletop load-bearing structure exhibits less of a clearance height than the frame or, respectively, the underedge of the folded-up tabletop, spacer parts are provided in order to support the tabletop on the legs of the support such that it extends horizontally in the used position. These spacer parts are preferably secured to the underside of the table top and rest on the upper side of the frame support or, respectively, have a clamped engagement with the legs of the support. With respect to their clamping power, the clamp parts are preferably designed such that the clamping engagement can be simply released in that the tabletop is lifted out of its use position. Alternatively thereto, a stronger clamp hold can be provided that, for example, allows the table to be rolled away by lifting slightly at its wheel-free side while applying force to the tabletop, and grips are provide at the clamp parts for releasing the clamp hold.

Advantageously, measures are inventively undertaken in order to releasably fix the tabletop folded up into its vertical position. A means for locking the tabletop preferably comes into consideration therefor. In its simplest embodiment, this locking mechanism can be composed of a mechanically actuatable drop latch that is supported at the tabletop load-bearing structure in its locking position. An advantageous development of this basic embodiment provides a bolt that is spring-biased in its unlocking position, that is guided at the tabletop and can be latched into its locking position wherein it is supported at the tabletop.

In the simplest embodiment of the inventive table, the folding-up of the tabletop ensues exclusively manually. However, a folding-up promoted by an auxiliary means such as, for example, folding the tabletop up with assistance from a gas pressure spring is preferred, this also fundamentally enabling the tabletop to be independently pivoted into its vertical position.

The invention is explained in greater detail below by way of example and on the basis of the drawing; shown are:

BRIEF DESCRIPTION OF THE DRAWINGS

FIGS. 2A–2D different embodiments of the tabletop spacer parts;

DETAILED DESCRIPTION OF THE PREFERRED EMBODIMENT

Figure 1:
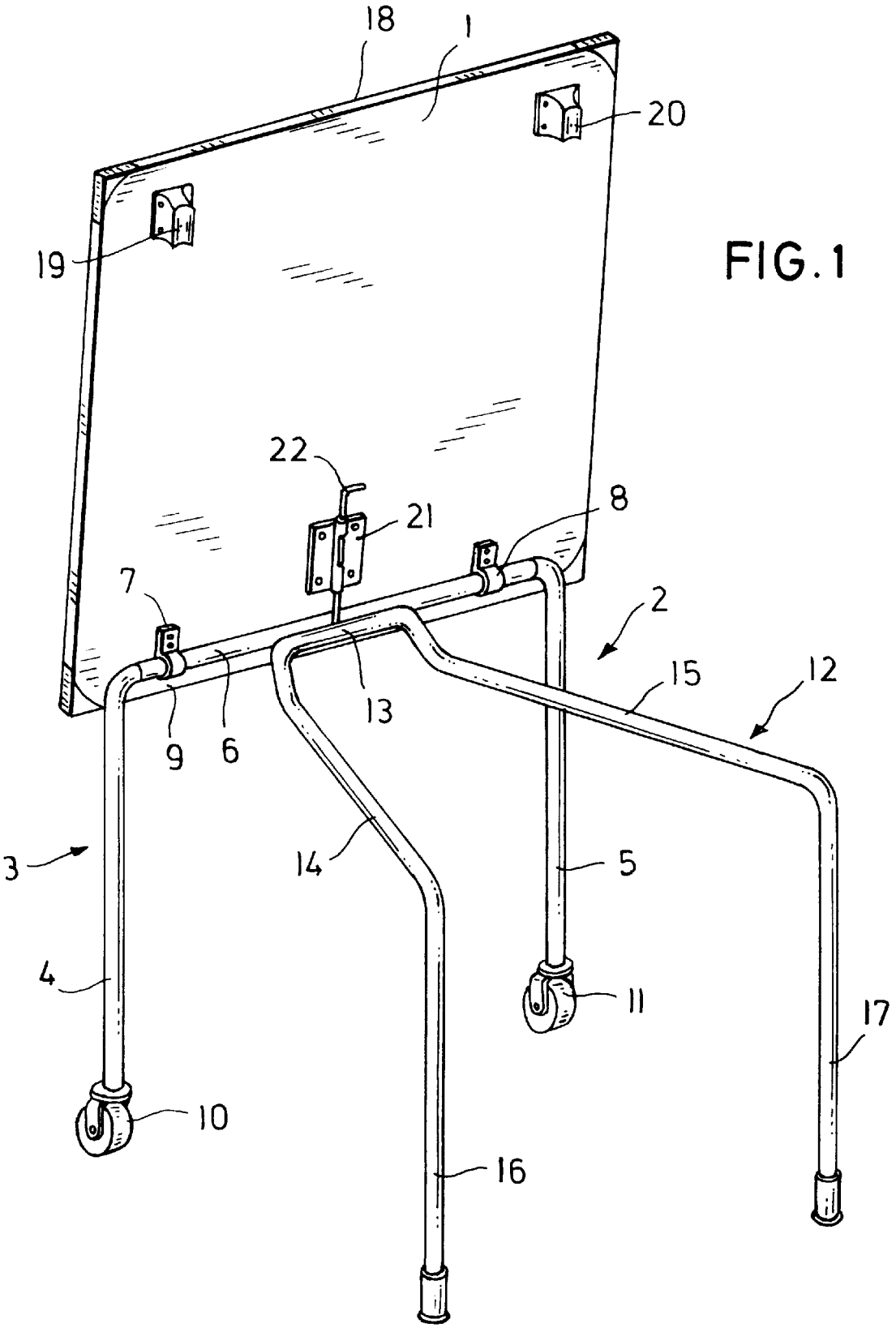
FIG. 1 a perspective view of the inventive table with the table top folded up.

The table shown in FIG. 1 comprises a tabletop 1 and a load-bearing structure 2 for the table top 1. The load-bearing structure 2 is composed of a vertically proceeding, U-shaped frame 3 standing on its head with two lateral, vertically proceeding legs 4 and 5 and a horizontal base 6 lying at the top. This U-shaped frame is preferably bent of a metal tube. The tabletop 1 is hinged to the frame base 6 with two plastic brackets 7 and 8. The brackets 7 and 8 are located offset inward from the lower edge 9 of the tabletop 1 folded up into its vertical position in FIG. 1, and the lower edge 9 projects from the base 6 by a predetermined dimension in downward direction. The lower ends of the two frame legs 4 and 5 are equipped in a known way with rollers or, respectively, wheels 10 or, respectively, 11 that are seated pivotable around a vertical axis.

The load-bearing structure is also composed of a support 12 with a generally V-shaped form. Given the embodiment shown in FIG. 1, the support 12 is form of one piece from a correspondingly bent tube. The apex of the V-shaped support 12 is fashioned flattened, and this straight support element 13 is centrally welded to the frame base 6. Vertically diverging legs adjoin the horizontally proceeding support part 13, said legs proceeding essentially horizontally in a first section 14 and 15 and merging into vertically downwardly extending table legs 16 and 17. With respect to their length, the horizontal sections 14 and 15 of the support 12 roughly correspond to the length of the tabletop 1 from its lower edge 9 up to its upper edge 18, with reference to the folded-up position of the tabletop 1 in FIG. 1, and spacer parts 19 and 20 with which the tabletop 1 swivelled into its horizontal use position rests on the horizontally proceeding sections 14 and 15 of the support 12 are provided at the underside of the tabletop 1 in the region of the upper edge 18.

Inventively, the height of the horizontal support sections 14 and 15 is less than the height of the lower edge 9 of the tabletop 1 proceeding from the substrate or, respectively, the underside of the wheels 10, 11 in their folded-up position. In the embodiment of FIG. 1, this height difference is realized in that the support 12, proceeding from its connecting region 13 to the frame 3, proceeds downwardly bent before it merges into the two horizontal leg sections 14 and 15. As proceeds, for example, from FIG. 4, this reduced height of the support 12 compared to the frame 3 or, respectively, to the lower edge 9 of the folded-up tabletop 1 allows a plurality of inventive tables with folded-up tabletops to be nested in one another to achieve a space-saving, horizontal stacking of the tables (see FIG. 4), whereby the stack density, which typically amounts to about 10 cm, is determined by the steepness of the bent-off region between the connecting region 13 and the horizontal support legs 14 and 15.

Figure 3:
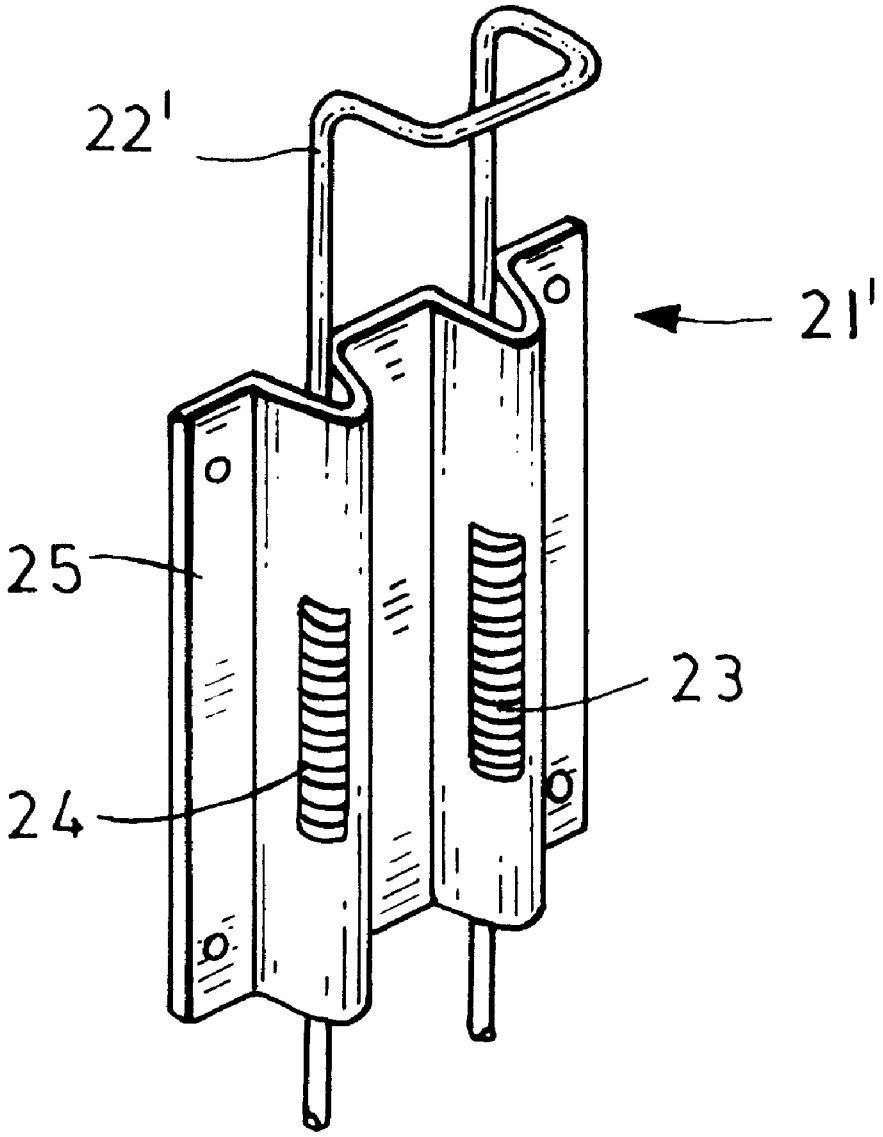
FIG. 3 a preferred embodiment of a tabletop locking mechanism for fixing the vertical tabletop position shown in FIG. 1.

As proceeds from FIG. 1, a locking mechanism 21 is secured to the underside of the tabletop 1 above its lower edge 9, said lock mechanism 21 comprising a drop latch 2 that can be arrested in a locking position in which its lower end is supported on the horizontal base of the frame 3. For unlocking, the latch 22 is pivoted around its longitudinal axis in a known way and pulled up in FIG. 1. An alternative embodiment of a locking mechanism 21' is schematically shown in FIG. 3. In accord therewith, the latch 22' comprises a bow shape and is pre-stressed or biased into its unlocking position relative to the housing 25 of the locking mechanism with two springs 23 and 24 that surround its two legs and can be latched into its locking position in a way that is now shown.

Alternative forms of the two tabletop spacer parts 19 and 20 are shown in FIGS. 2A through 2D. These spacer parts are preferably fashioned as injected plastic parts and respectively comprise a fastening flange 30 with four fastening holes for fastening to the underside of the tabletop 1 as well as a saddle-shaped supporting part 31 having a partly cylindrical supporting surface 32 that is matched to the contour of the tubular leg sections 14 and 15.

Figure 4:
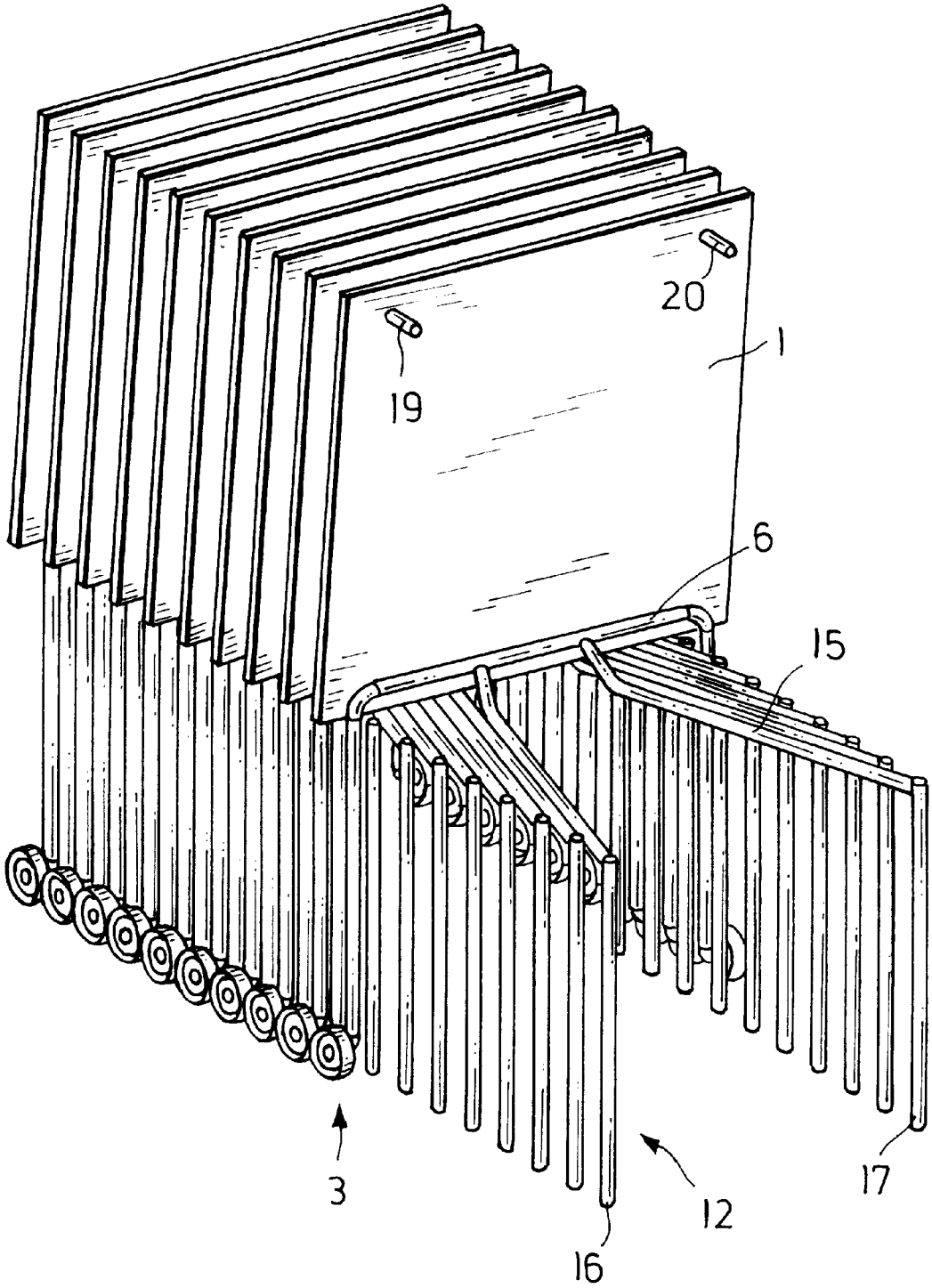
FIG. 4 a plurality of horizontally stacked, inventive tables with an alternative embodiment of the V-shaped support of the tabletop load-bearing structure.

FIG. 4 also discloses a modified embodiment of the support 3 that does not comprise a horizontal connecting part 13 but has its horizontal leg sections 14, 15 that are bent upward in the connecting region welded to the base of the U-shaped frame 3, whereas its ends remote from the base are welded to vertical table legs 16, 17.

Figure 5:
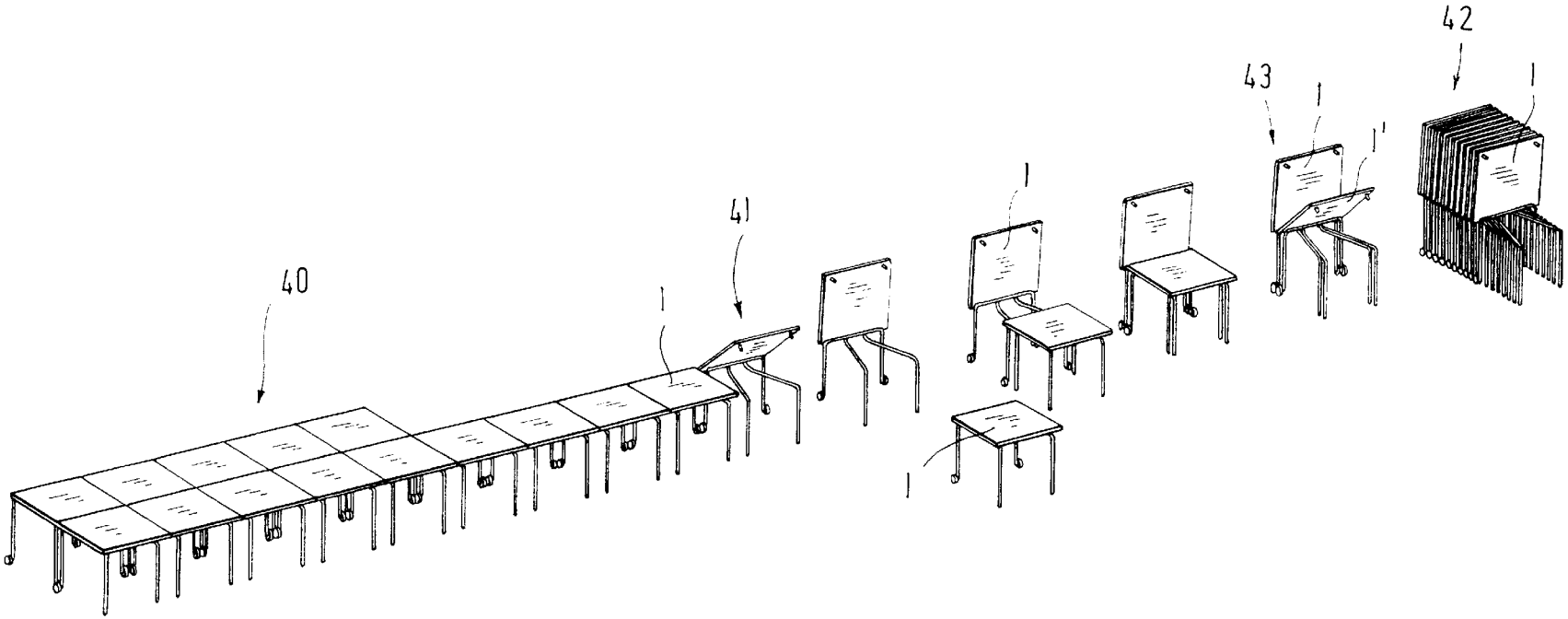
FIG. 5 a number of use position of the inventive table.

Different forms of using the inventive table proceed from FIG. 5 by way of example. A plurality of inventively fashioned tables with their tabletops folded down into their use position is shown in the left part of FIG. 5, these tables being placed against one another to form a conference table 40. At 41, a table with its tabletop in a transitional position between use position and vertical position is shown at the right-hand end of this table arrangement. The tabletop is converted into this position by lifting at the edge remote from its swivel articulation. The pivot of the tabletop into its vertical position can be supported, for example, by a gas compression spring that is not shown.

Figure 6:
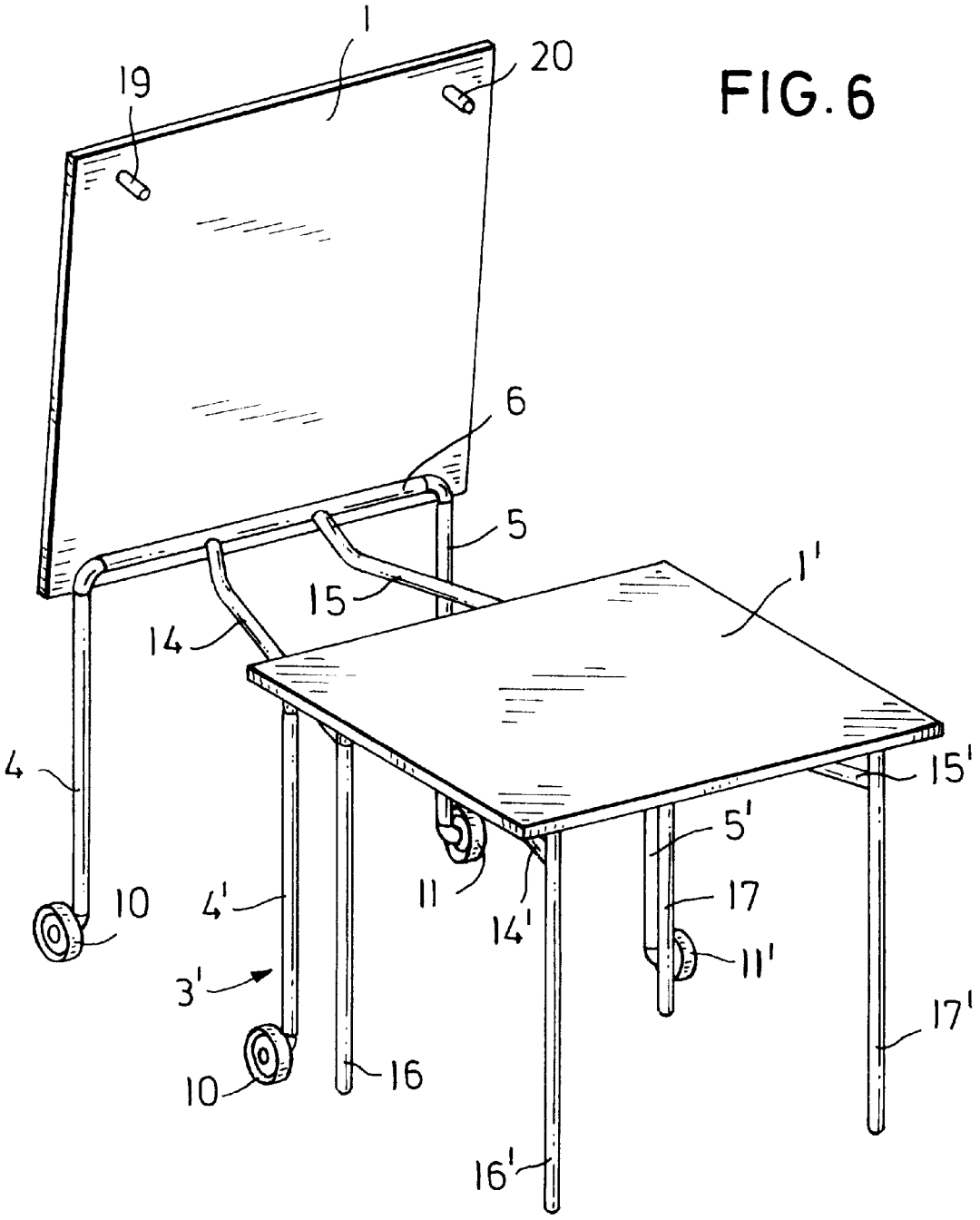
FIG. 6 one of the use and transitional positions of the inventive table shown in FIG. 5 together with a traditional table provided with rollers.

The horizontal stacking of a plurality of tables according to FIG. 4 is shown at the far right in FIG. 5, whereas the beginning of the stacking action is shown to the left thereof at 43 and in the detail in FIG. 6 on the basis of two identical, inventive tables, in accord wherewith a second table is rolled over the support 12 of the first table (whose tabletop is folded up) until the horizontal base of the vertical frame 3' of this table strikes against the bend region of the horizontally proceeding supporting legs 14, 15 of the first table, whereupon the tabletop 1' of the second table is folded up, so that further tables can be connected in this way in order to form a horizontal stack of tables.

What is claimed is:

1. A table comprising a tabletop and a load-bearing structure, the load bearing structure comprising a vertical frame member and a divergent V-shaped frame member, the vertical frame member having an underside portion and an opposed upside portion, a plurality of rollers rotatably mounted to the underside portion and the tabletop being hingedly pivotally mounted at one side to the upside portion and rotatable between a raised, vertically-oriented storage position and a lowered, horizontally-oriented use position; and the divergent V-shaped frame member including a base portion connected to the upside portion and a pair of legs extending from opposed ends of the base portion, the legs extending outwardly and downwardly to free ends spaced from the underside portion, the outwardly extending portions of the legs being disposed at a height which is less than a height of the upside portion, a side of the tabletop spaced from the upside portion, in the lowered horizontally-oriented use position, being supported by the legs, whereby a plurality of the tables with their tabletops in their raised storage positions may be nested and stacked together in a high density storage arrangement, such that the divergent V-shaped frame member of a first table is received through the vertical frame member of a second table to rest adjacent the divergent V-shaped frame member of the second table.

2. A table according to claim 1, wherein the vertical frame member comprises an inverted U-shaped frame including a horizontal base forming the upside portion to which the tabletop is pivotably hinged and having dependent lateral legs forming table legs.

3. A table according to claim 1, wherein the outwardly extending portions of the legs extend generally horizontally away from the upside portion a distance corresponding to a horizontal width distance of the tabletop.

4. A table according to claim 1, further including spacer parts disposed between the outwardly extending portions of the legs and an underside surface of the tabletop for supporting the tabletop in the lowered, horizontally oriented position of use.

5. A table according to claim 4, wherein the spacer parts are secured to the underside surface of the tabletop.

6. A table according to claim 4, wherein the spacer parts include a releasable clamp member releasably clamping the tabletop to the outwardly extending portions of the legs.

7. A table according to claim 6, wherein the clamps include grip portions for releasing the clamp members from clamped engagement with the outwardly extending portions.

8. A table according to claim 4, wherein the spacer parts are plastic.

9. A table according to claim 1, further including a locking mechanism mounted to the tabletop which releasably bears against the load bearing structure maintaining the tabletop in its raised, vertically oriented storage position.

10. A table according to claim 9, wherein the locking mechanism includes a spring loaded locking latch mounted to the tabletop which, in its locked position, bears against the load bearing structure in a manner which prevents rotation of the tabletop away from its raised, vertically oriented storage position.

11. A table according to claim 1, wherein the divergent V-shaped frame member comprises a one-piece shaped tubing secured to the vertical frame member.

12. A table according to claim 11, wherein the one-piece shaped tubing is metal.

13. A table according to claim 12, wherein the tubing is welded to the vertical frame member.

14. A table comprising a tabletop and a load-bearing structure, the load bearing structure comprising a vertical frame member and a divergent V-shaped frame member, the vertical frame member having an underside portion and an opposed upside portion, the tabletop being hingedly pivotally mounted at one side to said upside portion and rotatable between a raised, vertically oriented storage position and a lowered, horizontally oriented use position; and a divergent V-shaped frame member including a base portion connected to the upside portion and a pair of legs extending from opposed ends of the base portion, the legs extending outwardly and downwardly to free ends spaced from the underside portion, the outwardly extending portions of the legs being disposed at a height which is less than a height of the upside portion, a side of the tabletop spaced from the upside portion, in the lowered horizontally oriented use position, being supported by the legs, whereby a plurality of tables with their tabletops in their raised storage positions, may be nested and stacked together in a high density storage arrangement, such that the divergent V-shaped frame member of a first table is received through the vertical frame member of a second table to lie adjacent the divergent V-shaped member of the second table.

15. A table comprising a tabletop and a load-bearing structure, the load bearing structure comprising a vertical frame member and a divergent V-shaped frame member, the vertical frame member having an underside portion and an opposed upside portion, a plurality of rollers rotatably mounted to the underside portion and the tabletop being hingedly pivotally mounted at one side to the upside portion and rotatable between a raised, vertically-oriented storage position and a lowered, horizontally-oriented use position; and the divergent V-shaped frame member including a base portion connected to the upside portion and a pair of legs extending from opposed ends of the base portion, the legs extending outwardly and downwardly to free ends spaced from the underside portion, the outwardly extending portions of the legs being disposed at a height which is less than a height of the upside portion, a side of the tabletop spaced from the upside portion, in the lowered horizontally-oriented use position, being supported by the legs, the table further including a locking mechanism mounted to the tabletop which releaseably bears against the load-bearing structure maintaining the tabletop in its raised, vertically oriented storage position, whereby a plurality of the tables with their tabletops in their raised storage positions may be nested and stacked together in a high density storage arrangement, such that the divergent V-shaped frame member of a first table is received through the vertical frame member of a second table to rest adjacent the divergent V-shaped frame member of the second table.

16. A table according to claim 15, wherein the locking mechanism includes a spring loaded locking latch mounted to the tabletop which, in its locked position, bears against the load bearing structure in a manner which prevents rotation of the tabletop away from its raised, vertically oriented storage position.

* * * * *